US007445265B1

(12) United States Patent
Neumann et al.

(10) Patent No.: US 7,445,265 B1
(45) Date of Patent: Nov. 4, 2008

(54) SHIELD ASSEMBLY FOR CARGO SPACE OF A TRANSPORT VEHICLE

(75) Inventors: Dietmar Neumann, Pointe Claire (CA); Adrian Radulescu, Laval (CA)

(73) Assignee: Chameleon Transportation Systems Inc., Pointe-Claire, Quebec (CA)

( * ) Notice: Subject to any disclaimer, the term of this patent is extended or adjusted under 35 U.S.C. 154(b) by 11 days.

(21) Appl. No.: 11/741,822

(22) Filed: Apr. 30, 2007

(51) Int. Cl.
*B60P 7/02* (2006.01)

(52) U.S. Cl. ..... 296/100.16 B; 296/100.12

(58) Field of Classification Search ..... 296/100.16, 296/186.1, 186.2, 100.15, 100.12; 160/329, 160/206, 84.01, 155; 410/145
See application file for complete search history.

(56) References Cited

U.S. PATENT DOCUMENTS 3,231,305 A * 1/1966 Beckman ..... 296/100.12
3,709,552 A * 1/1973 Broadbent ..... 296/186.2
4,569,293 A * 2/1986 Kramer et al. ..... 105/377.1
4,711,484 A * 12/1987 Tuerk ..... 296/105
4,799,528 A * 1/1989 Benitez ..... 160/199
4,828,316 A * 5/1989 Bennett et al. ..... 296/186.2
4,902,064 A * 2/1990 Tuerk et al. ..... 296/100.12
4,938,523 A * 7/1990 Camp ..... 296/159
5,005,896 A * 4/1991 Li ..... 296/100.18
5,080,422 A * 1/1992 DeMonte et al. ..... 296/100.12
5,152,575 A * 10/1992 DeMonte et al. ..... 296/100.12
5,215,349 A * 6/1993 Horton ..... 296/186.2
5,271,336 A * 12/1993 Willetts ..... 296/98
5,338,084 A * 8/1994 Wardell ..... 296/100.12
6,065,796 A * 5/2000 Verduyn ..... 296/100.17
6,634,697 B1 * 10/2003 Petelka ..... 296/100.12
6,905,161 B2 * 6/2005 Fliege et al. ..... 296/100.16
6,976,433 B1 * 12/2005 Neumann ..... 296/100.12
7,249,796 B2 * 7/2007 Henning ..... 296/105
7,374,225 B2 * 5/2008 Petelka ..... 296/100.11

* cited by examiner

*Primary Examiner*—Kiran B. Patel
(74) *Attorney, Agent, or Firm*—Ogilvy Renault

(57) ABSTRACT

A shield assembly is described for the cargo space of a transport vehicle wherein access to the cargo space is provided by a displaceable wall section mounted on a lower rail secured spaced from a lower side frame of the cargo space. The assembly comprises an elongated rectangular flexible seal guard having an elongated securable side edge section. The flexible seal guard has a width which is greater than a space defined between the rail and the lower side frame. The rail has a directional retention slot for immovably securing the securable side edge section of the flexible seal guard thereto whereby the flexible seal guard is supported for frictional engagement at an opposed free side edge against the lower side frame to substantially seal the space whereby to prevent foreign matter from entering into the cargo space.

12 Claims, 2 Drawing Sheets

SHIELD ASSEMBLY FOR CARGO SPACE OF A TRANSPORT VEHICLE

TECHNICAL FIELD

The present invention relates to a shield assembly for preventing foreign matter from entering into the cargo space of a transport vehicle of the type having a displaceable wall section providing access to the cargo space and mounted on a lower rail which is secured to a side frame of the transport vehicle.

BACKGROUND ART

Many transport vehicles, such as tractor trailers or railway cars are equipped with tarp enclosures which provide total access to the interior of the vehicle. These tarp enclosures are usually supported by a framework which is mounted on rails or tracks which are secured to the lower side frame of the cargo bed of the vehicle and displaceable therealong. A problem with such displaceable wall sections is that the tarp is supported spaced from the lower side frame of the cargo bed whereby to permit a folding of the tarp in accordion fashion and also to prevent entanglement with the cargo bed or merchandise supported thereon. This spacing causes foreign matter such as water and dust to enter into the cargo space through the spacing between the lower section of the tarp and the cargo bed, and often causing damage to merchandise being transported in the cargo space. There is also a need to protect the rail on which these collapsible tarps are supported to prevent foreign matter from entering into the rail and causing the support wheels of the framework to jam or otherwise malfunction. During winter season, the roads on which the tractor trailers operate are often covered with salt calcium or chemical and sand mixtures whereby to melt the icy road surface and such product, in melted form, is sprayed onto these rails and in the crevices between the tarps and the frame by the wheels of the vehicle and wind thereby resulting in corrosion and malfunctions.

SUMMARY OF INVENTION

It is a feature of the present invention to provide a shield assembly which substantially overcomes the above-mentioned disadvantages of the prior art.

According to the above feature, from a broad aspect, the present invention provides a shield assembly for the cargo space of a transport vehicle wherein access to the cargo space is provided by a displaceable wall section mounted on a lower rail secured spaced from a lower side frame of the cargo space. The assembly comprises an elongated rectangular flexible seal guard having an elongated securable side edge section. The flexible seal guard has a width which is greater than a space defined between the rail and the lower side frame. The rail has retention means for immovably securing the securable side edge section of the flexible seal guard thereto whereby the flexible seal guard is supported for frictional engagement at an opposed free side edge against the lower side frame to bridge and substantially seal the space to prevent foreign matter from entering into the cargo space.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
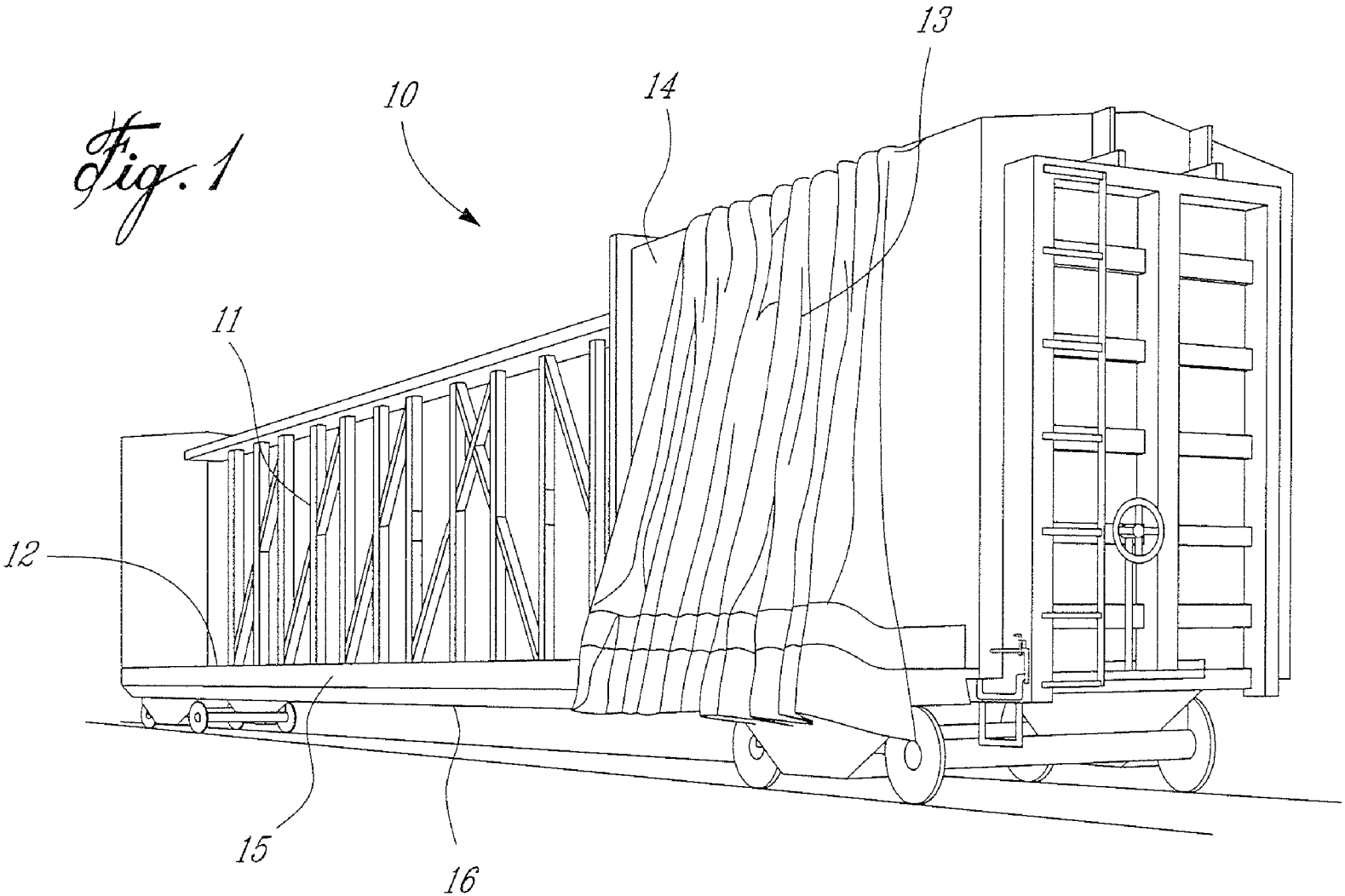
FIG. 1 is a perspective view showing a rail car provided with a cargo space which is provided with a displaceable tarp closure to provide access to the cargo space and wherein the enclosure is mounted on support rails.

Referring now to the drawings and more particularly to FIG. 1, there is shown generally at 10 a transport vehicle in the form of a rail car which defines a cargo space 11 defined over an open-ended cargo bed 12. A displaceable tarp closure 13 is supported by a framework 14, herein only partly illustrated which is displaceably supported on support rails 15 which are secured adjacent the trailer lower side frame 16 on opposed sides of the cargo bed. The present invention is illustrated in FIGS. 2 and 3 and concerns a shield assembly associated with the support rail 15.

Figure 2:
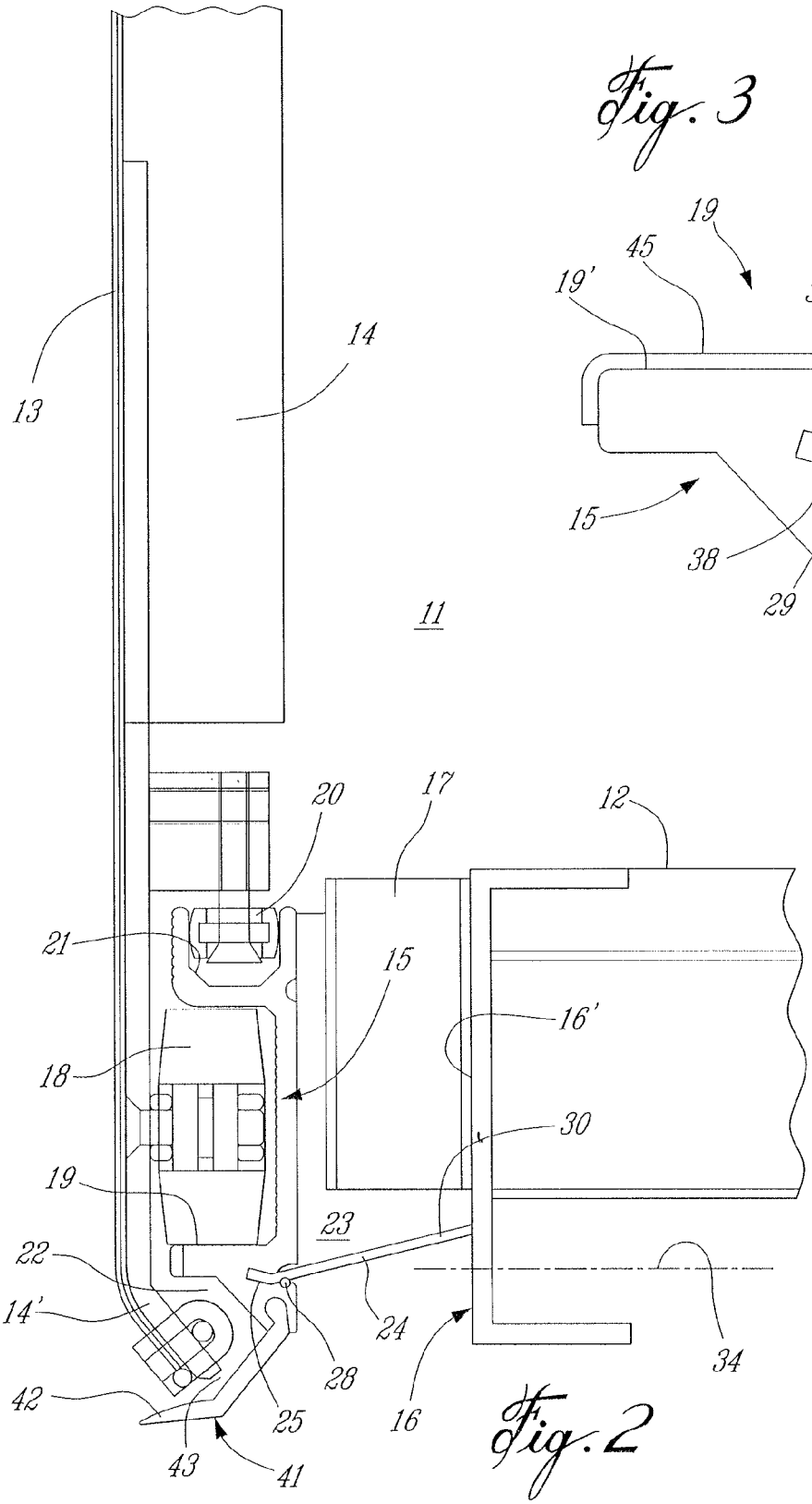
FIG. 2 is a section view illustrating the construction of the shield assembly of the present invention.
Figure 3:
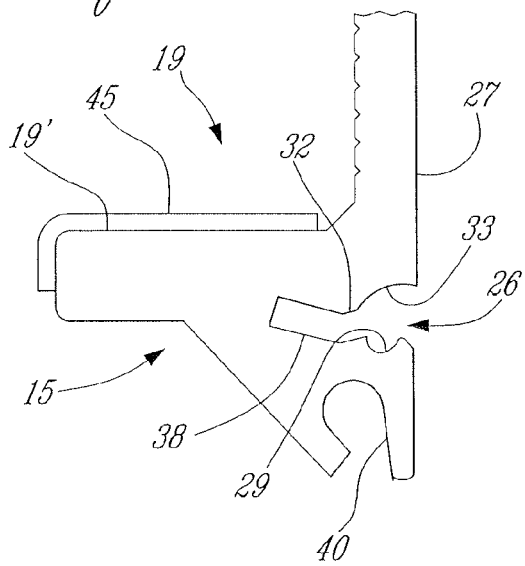
FIG. 3 is an enlarged section view of the lower section of the rail forming part of the shield assembly.

As shown in FIG. 2, each support rail 15 is formed as an elongated extruded metal rail, herein extruded from aluminum, and it is secured to the trailer side frame 16 by spacer blocks 17 secured at spaced intervals therealong. The support framework 14 is slidingly and guidingly supported along the support rail 15 by ball bearing wheels 18 which are retained captive in a track 19 by such means as the guide wheels 20 retained captive in a top channel 21. The bottom end of the frame 14 has an inwardly bent section 14' whereby the tarp can be folded under the track 19 to protect the wheels 18 and 20 against foreign matter lodging itself in the track 19 and channel 21. However, small openings 22 are still present whereby to maintain the tarp spaced from the track and the wheel mechanisms to prevent malfunction.

Because the support rail 15 is supported spaced from the trailer lower side frame 16 there is a large space 23 between the support rail 15 and the trailer side frame surface 16'. This space 23 extends between the spacing blocks all along the side frame and communicates with the cargo space 11 above the cargo bed 12.

In order to isolate the space 23 between the lower trailer side frame 16 and the support rail 15, an elongated rectangular flexible seal guard 24 is provided and herein shown in cross-section only. This seal guard has an elongated securable side edge section 25 which is retained in a retention means constituted by a configured retention slot 26, as better illustrated in FIG. 3, and formed in the support rail 15 in an inner face 27 thereof which faces the lower trailer side frame inner surface 16'. The retention slot 26, as better illustrated in FIG. 3, receives the securable side edge section 25 of the flexible seal guard 24 therealong. In order to secure this seal guard 24, there is provided an arresting means in the form of an elongated locking insert 28 which is inserted in the retention slot 26 in an elongated cavity 29 located internally of the retention slot whereby to wedge the securable side edge section 25 of the flexible seal guard 24 inside the retention slot 26. The locking insert 28 is a flexible plastic (Delrin™) rod of circular cross-section. In order to facilitate installation or replacement of the elongated locking insert 28 there is provided an insert installation sliding tool.

As shown in FIG. 2, the flexible seal guard 24 has a width which is greater than the width of the space 23 whereby the flexible seal guard 24 when secured in the retention slot 26 has its free end section 30 disposed in frictional engagement with the inner surface 16' of the lower trailer side frame 16 to seal the space 23 to prevent foreign matter from entering into the cargo space 11 above the cargo bed 12.

As more clearly shown in FIG. 3, the retention slot 26 is provided with an elongated abutment 32 formed therealong in a top wall of the retention slot opposite the elongated cavity 29 and spaced inwardly thereof. The elongated cavity 29 is arcuately shaped to receive the locking insert 28 of circular cross-section in sliding fit therein. The securable side edge section 25 of the seal guard 24 is wedged between the locking insert 28 and the elongated abutment 32. This seal guard is fabricated of neoprene rubber and therefore has rigidity and flexibility. Accordingly, a rigid connection is achieved by this wedging connection and the seal guard bridges the gap of the space 23.

The retention slot 26 is also provided with a bottom straight end section 38 disposed rearwardly of the elongated abutment 32 and extending upwardly of the horizontal plane 34. The securable side edge section of the flexible seal guard is disposed in close sliding fit in this bottom straight end section of the slot and together with the locking insert 28 the seal guard 24 is immovably connected in the slot 26 due to this angular configuration of the securable side edge section 28 of the seal guard 24.

As also shown in FIG. 3, the retention slot has an enlarged mouth opening 33 with the elongated cavity 29 being disposed along a lower wall of the retention slot in the enlarged mouth opening whereby to orient the flexible seal guard 24 angulated upwards of the horizontal plane 34 as illustrated in FIG. 2. The neoprene seal guard 24 is substantially rigid to retain good frictional contact with the inner surface 16' of the trailer side frame 16 and will resist pressure from air and foreign matter impinged thereon from below as the vehicle is in motion over a road surface or rail tracks.

As shown in FIGS. 2 and 3, the extruded support rail 15 is further provided with an elongated bottom retention cavity 40 extending therealong. A deflection guard 41 (see FIG. 2) is slidingly connected in the bottom retention cavity 40 in a manner well known in the art. The deflection guard 41 is also constructed of neoprene rubber and has an inwardly configured flange section 42 which extends under the lower end 14' of the support frame 14 whereby to prevent foreign matter from entering into the underspace 22. As the vehicle is displaced, upward air pressure is exerted on this deflection guard 41 causing it to move up against the lower free end 14' of the support frame substantially sealing the underspace 22. When the vehicle is not in motion, the deflection guard re-assumes its normal state providing a clearance 43 from the end 14' of the support frame to permit proper non-interference displacement thereof.

As further illustrated in FIG. 3, wear resistant insert plates 45 are positioned at predetermined locations along the bearing surface 19' of the track 19 where the wheels 18 rest when the tarp closure 13 is in a closed position of use. These plates are made of stainless steel or other suitable wear resistant material to prevent wear caused by vibration of the wheels 18 when the transport vehicle is in operation.

In conclusion, it can be appreciated that this shield assembly substantially seals all of the space 23 between the support rail 15 and the inner cargo space 11 and at the same time protects the frame support mechanism which is secured to the support rail to prevent wear-and-tear thereof by foreign matter.

It is within the ambit of the present invention to cover any obvious modifications of the preferred embodiment described herein, provided such modifications fall within the scope of the appended claims.

We claim:

1. A shield assembly for the cargo space of a transport vehicle wherein access to said cargo space is provided by a displaceable wall section mounted on a lower rail secured spaced from a lower side frame of said cargo space, said assembly comprising an elongated rectangular flexible seal guard having an elongated securable side edge section, said flexible seal guard having a width which is greater than a space defined between said rail and said lower side frame, said rail having retention means for immovably securing said securable side edge section of said flexible seal guard thereto whereby said flexible seal guard is supported for frictional engagement at an opposed free side edge against said lower side frame to bridge and substantially seal said space to prevent foreign matter from entering into the cargo space.

2. A shield assembly as claimed in claim 1 wherein said retention means is constituted by a configured retention slot formed in said rail in a surface thereof facing said side frame, said retention slot receiving said securable side edge section of said flexible seal guard therealong, sand arresting means to immovably retain said securable side edge section in said retention slot.

3. A shield assembly as claimed in claim 2 wherein said retention slot is provided with an elongated cavity internally thereof whereby to receive an elongated locking insert therealong constituting said arresting means for wedging said securable side edge section in said retention slot.

4. A shield assembly as claimed in claim 3 wherein said retention slot has an elongated abutment formed therealong in a wall of said slot opposite said elongated cavity and spaced inwardly thereof, said securable side edge section being wedged between said locking rod and said elongated abutment.

5. A shield assembly as claimed in claim 4 wherein said retention slot has an enlarged mouth opening, said elongated cavity extending along a lower wall of said retention slot in said enlarged mouth opening whereby to orient said flexible seal guard angulated upwards of a horizontal plane.

6. A shield assembly as claimed in claim 5 wherein said retention slot has a bottom end section disposed rearwardly of said elongated abutment and extending upwardly of said horizontal plane.

7. A shield assembly as claimed in claim 3 wherein said elongated locking insert is a flexible rod of circular cross-section.

8. A shield assembly as claimed in claim 2 wherein said rail is an elongated extruded rail, said rail having an elongated bottom retention cavity extending therealong, and a deflection guard retained by said bottom retention cavity to deflect foreign matter away from a bottom end of said rail.

9. A shield assembly as claimed in claim 8 wherein said flexible seal guard and said deflection guard are constructed of neoprene material exhibiting rigidity and flexibility.

10. A shield assembly as claimed in claim 1 wherein said transport vehicle is one of a tractor trailer or rail car having at least one side wall thereof formed by a displaceable and collapsible membrane secured to a support frame displaceable along said lower rail.

11. A shield assembly as claimed in claim 7 wherein said flexible rod is a plastic rod.

12. A shield assembly as claimed in claim 8 wherein said rail is provided with a track to receive ball bearing wheels therein, said track having a wheel bearing surface provided with wear resistant insert plates to prevent wear in said bearing surface in predetermined areas along said bearing surface by vibrations imparted to said wheels.

* * * * *